US005632321A

United States Patent [19]

Hegel et al.

[11] Patent Number: 5,632,321

[45] Date of Patent: May 27, 1997

[54] DIE CASTING MACHINE WITH COMPOUND DOCKING/SHOT CYLINDER

[75] Inventors: Robert W. Hegel, Holland; Melvin C. Hawke, Norton Shores, both of Mich.

[73] Assignee: Prince Machine Corporation, Holland, Mich.

[21] Appl. No.: 606,331

[22] Filed: Feb. 23, 1996

[51] Int. Cl.[6] ..... B22D 17/12

[52] U.S. Cl. ..... 164/315; 164/312

[58] Field of Search ..... 164/312, 314, 164/315, 113

[56] References Cited

U.S. PATENT DOCUMENTS

| | | | |
|---|---|---|---|
| 3,344,848 | 10/1967 | Hall et al. . | |
| 3,605,871 | 9/1971 | Whitehead, Sr. et al. . | |
| 4,088,178 | 5/1978 | Ueno et al. . | |
| 4,287,935 | 9/1981 | Ueno et al. . | |
| 4,655,274 | 4/1987 | Dannoura . | |
| 4,741,379 | 5/1988 | Dannoura . | |
| 4,799,534 | 1/1989 | Ueno et al. . | |
| 4,828,010 | 5/1989 | Ueno et al. | 164/113 |
| 4,844,146 | 7/1989 | Kikuchi . | |
| 4,955,426 | 9/1990 | Akimoto et al. . | |
| 4,997,027 | 3/1991 | Akimoto . | |
| 5,127,467 | 7/1992 | Ueno . | |
| 5,205,339 | 4/1993 | Perrella . | |

FOREIGN PATENT DOCUMENTS

| | | | |
|---|---|---|---|
| 62-134155 | 6/1987 | Japan | 164/312 |
| 62-134156 | 6/1987 | Japan | 164/312 |
| 63-273559 | 11/1988 | Japan | 164/312 |

*Primary Examiner*—Kuang Y. Lin

*Attorney, Agent, or Firm*—Price, Heneveld, Cooper, DeWitt and Litton

[57] ABSTRACT

A vertical die cast apparatus having a novel docking/shot assembly in which the docking and docking cylinder and shot cylinder are constructed in one compound cylinder. A novel construction for supporting the docking/shot assembly is also provided.

23 Claims, 7 Drawing Sheets

DIE CASTING MACHINE WITH COMPOUND DOCKING/SHOT CYLINDER

BACKGROUND OF THE INVENTION

This invention relates to a vertical injection type die cast apparatus and more particularly, to a novel and unique docking/shot assembly in which the docking and shot cylinders are constructed in one compound cylinder. In addition, this invention relates to the means for supporting the shot cylinder assembly in relation to the stationary front platen and the die body of a horizontal mold clamping type of die cast apparatus or machine.

Die cast machines for casting injectable metal have been in existence for many years. Various types have been devised. One such type is the so-called vertical/horizontal machine in which the mold or die is horizontally clamped and the injectable material is vertically injected or shot into the mold. Another type is referred to as the vertical/vertical die casting machine in which the mold is clamped vertically and the injectable metal is also injected vertically into the mold. In both of these types of die casting machines, the apparatus for docking the injection sleeve into the gate of the mold or die and the apparatus for injecting the injectable metal into the mold or die have been accomplished by separate cylinders, making the apparatus complicated and to particularly occupy a substantial amount of space so as to interfere with other desired mechanisms located near the bottom of the die or mold. One such desired mechanism is a mechanism for actuating a movable core assembly, such mechanism located in the area near the bottom part of the die where previously constructed unwieldy structures for the separate docking cylinder and shot cylinder are located.

The above is only an example of a need for a simplified docking/shot apparatus wherein the injection sleeve can be docked into the gate of the die and subsequently a shot of injectable metal can be injected into the cavity of the die.

SUMMARY OF THE INVENTION

It is the object of the present invention to provide an improved docking/shot assembly by incorporating the docking piston and the shot piston in a compound cylinder. The compound cylinder includes a first cylinder and generally an outer cylinder having a chamber in which is located a docking piston. The docking piston in turn has a cylinder chamber in which is located a shot piston. Ports and passageways for pressurized fluid are provided in both of the outer cylinder and the cylinder formed in the docking piston. Also, valving is provided for causing pressurized fluid to first actuate the docking piston in the first chamber to dock the sleeve into the gate, and thereafter the shot piston is actuated in the cylinder of the docking piston to produce a shot of metal into the cavity of the die.

In accordance with this invention, the shot piston which is slidably mounted in the cylinder of the docking piston provides a surface which assists in the pressurized fluid forcing the docking piston upwardly to cause the injection sleeve to dock into the gate of the die. This is accomplished by the valving which initially prevents the shot piston from moving relative to the docking piston by reason of equal force on the top and bottom surfaces of the shot piston.

The above-described docking/shot assembly can be applied to vertical/vertical die casting apparatus or to horizontal die casting apparatus. One aspect of this invention provides in the horizontal/vertical (HV) die casting apparatus a unique means for supporting the compound cylinder described above so that it can be tilted for receiving a charge of the injectable metal and then pivoted to the upright docking position.

In accordance with this support aspect of the invention, the front stationary platen includes a downwardly extending portion located between elongated support members for the platens. This downwardly extending portion has a cutout extending upwardly from its lower edge through the space between the elongated support members. A support bracket assembly is attached to the downwardly extending portions of the front stationary platen on each side of the cutout to support the docking/shot assembly. The support bracket depending from said downwardly extending portion has a support assembly for pivotally mounting the docking/shot assembly. This structure provides for the docking/shot assembly to be pivotally mounted on the support bracket assembly so as to be pivoted from a docking position through the space provided by the cutout to a tilted loading position and vice versa.

The above objects and advantages of this invention will become evident from a review of the drawings and the following description.

DESCRIPTION OF THE PREFERRED EMBODIMENTS

Figure 2:
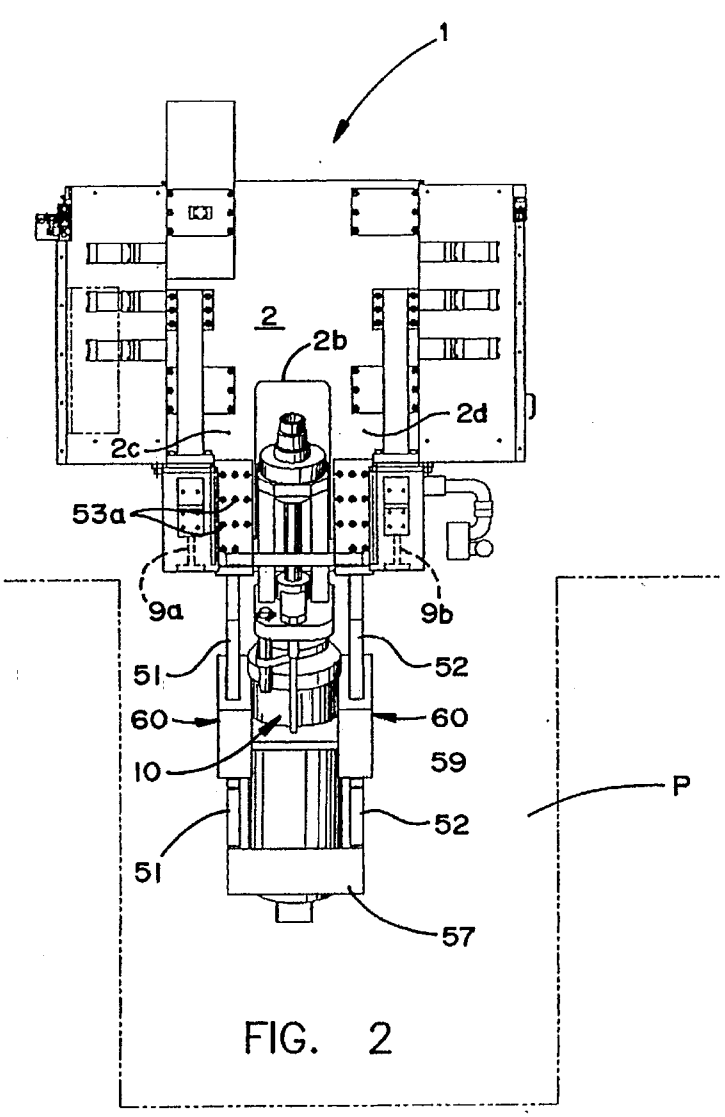
FIG. 2 is a front-elevational view of the invention as disclosed in FIG. 1.
Figure 1:
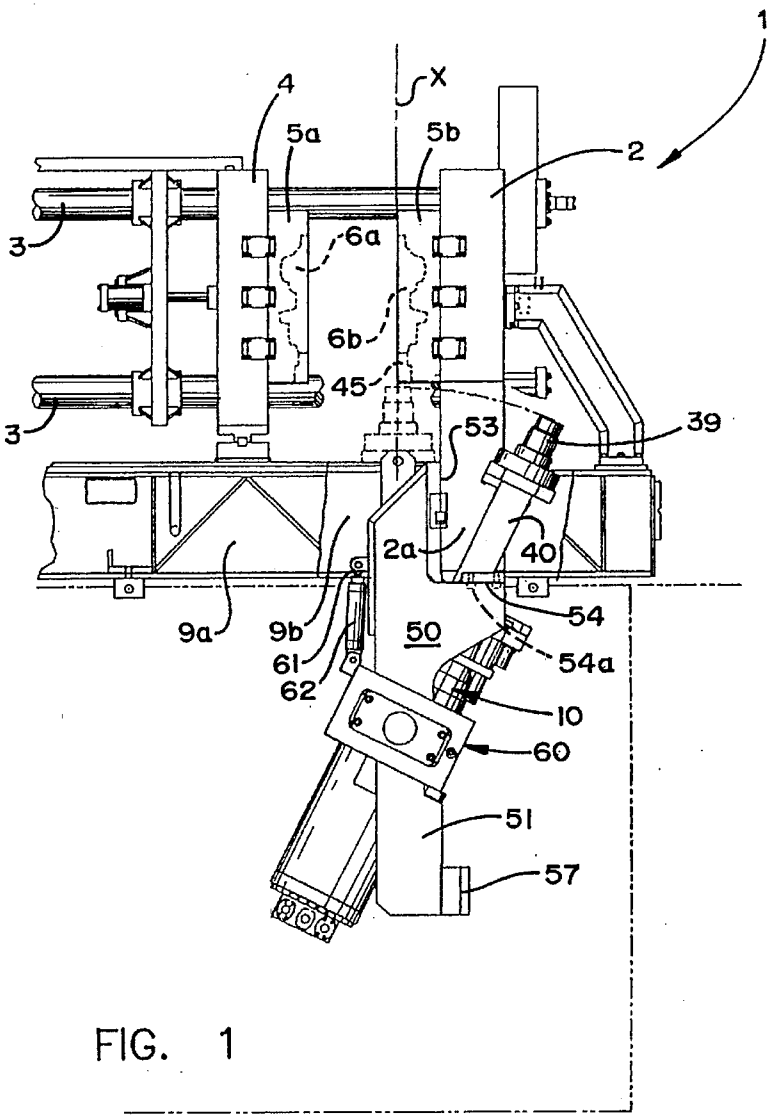
FIG. 1 is a side-elevational view of a portion of a die casting apparatus incorporating our invention and having a portion cutaway so as to more clearly illustrate the operation of the invention.

Referring to the drawings and particularly FIG. 1, reference numeral 1 designates a horizontal/vertical (HV) machine in which the horizontal mold clamping components are conventional. These conventional components include a stationary front platen 2 having tie rods 3 on which is supported a movable platen 4 which is horizontally movable with respect to the stationary platen 2. A die or mold 5 formed of two parts 5*a* and 5*b* is located between the platens 2 and 4. The die part 5*a* is mounted on the movable platen 4 and the die part 5*b* is mounted on the stationary front platen 2. The die parts 5*a* and 5*b* oppose each other and include cavities 6*a* and 6*b* forming a cavity in the split or mating plane X. An actuating rod is attached to the movable platen 4 and is attached to a toggle mechanism (not shown) which is actuated by a clamping cylinder (not shown), both of which are conventional. When the clamping cylinder is operated, the movable platen 4 is moved forward to clamp the die parts 5*a* and 5*b* closed so as to form cavity 6 in which injectable metal is injected through the gate 45 by means of the vertical injection type docking/shot assembly 10 which forms one major aspect of the present invention. The docking/shot assembly 10 is mounted on the front stationary platen 2 by means of the bracket support assembly 50. The entire die cast machine is mounted on the spaced beams 9*a* and 9*b* (FIG. 2). Generally, this type of apparatus is mounted with the docking/shot assembly 10 extending into a pit "P"; however, within the broadest aspect of this invention, the beams 9*a* and 9*b* could be elevated above the floor so as to eliminate the pit.

Figure 5:
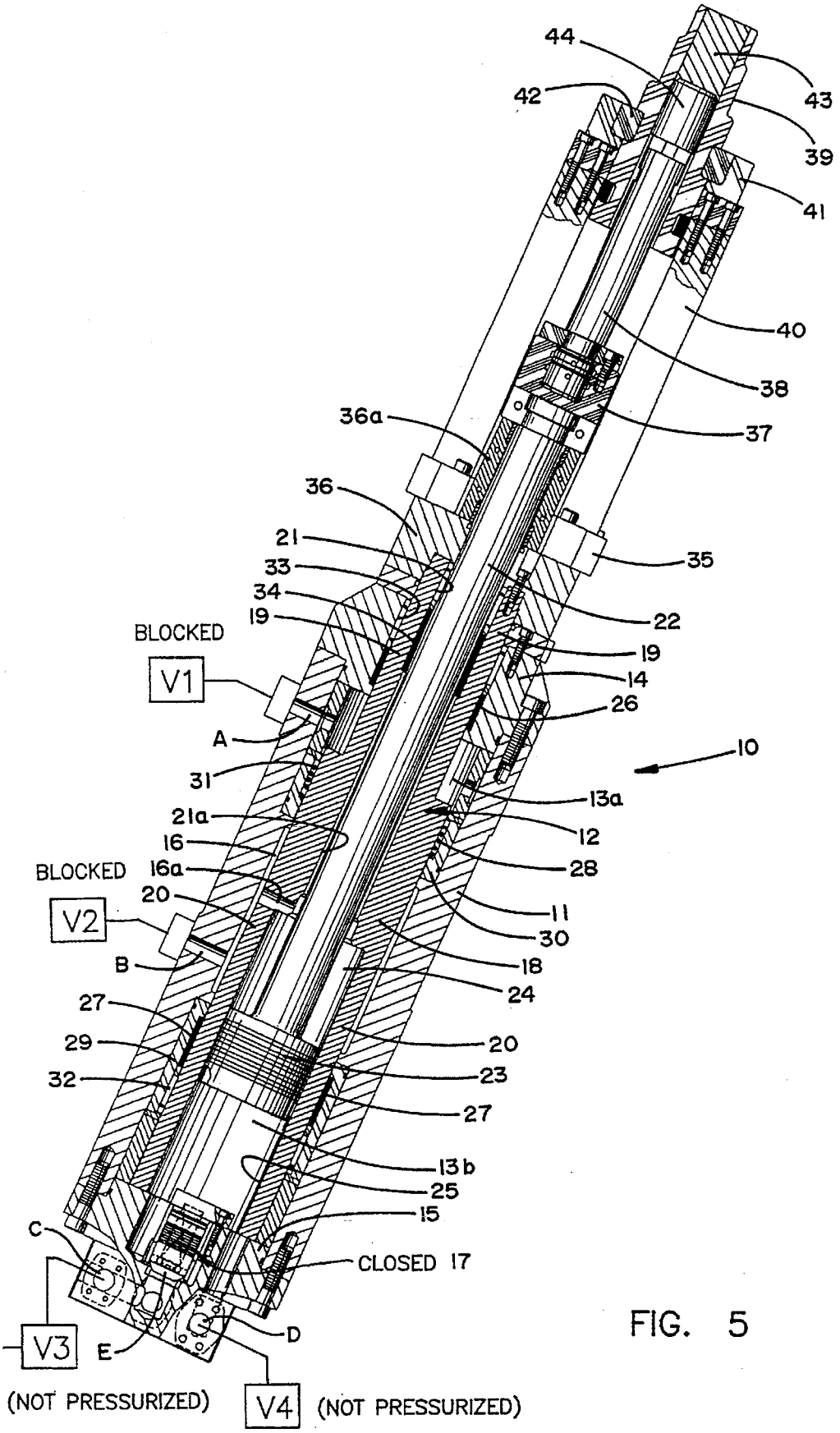
FIGS. 5–12 are elevational cross-sectional views of the docking/shot assembly of this invention showing the various components of the docking/shot assembly in various modes during the operation of the invention.

Reference is now made to FIG. 5 which discloses the various components of the docking/shot assembly 10 which includes an outer docking cylinder 11 having a chamber in which is slidably mounted the docking piston 12. The chamber within docking cylinder 11 is divided by docking piston 12 into an upper chamber 13*a* and a lower chamber 13*b*. The upper chamber 13*a* is closed at the upper end of cylinder 11 by the cylinder top closure 14 and at the lower end of cylinder 11, the lower chamber 13*b* is closed by the cylinder bottom closure 15. Cylinder 11 has several openings or ports including the port or opening A communicating with the upper chamber 13*a* and the port or opening B which communicates with the passageway 16 formed by a recess in the inner wall of cylinder 11. Passageway 16 provides communication between port or opening B and port or opening 16*a* which extends through the walls of cylinder portion 20. As a result, passageway 16 provides for flow of fluid from upper chamber 24 to opening or port B and vice versa. The closure member or cap 15 at the lower end of the cylinder 11 includes the openings C, D, and E. The opening or port C communicates with opening E. These two openings or ports are provided for the inlet of pressurized fluid into the lower chamber 13*b*. A check valve 17 is provided for opening and closing the port E as will be explained hereinafter. The port or opening D is provided for the purpose of introducing an intensified pressurized fluid into the lower chamber 13*b*.

The docking piston 12 includes an intermediate body portion 18 having a neck 19 integral therewith and extending upwardly through upper chamber 13*a* and through bore 21 of closure 14 and a cylinder portion 20 extending downwardly from the intermediate body portion 18. A bore 21*a* extends through the intermediate body 18 and neck 19 for receiving the piston rod 22 extending from the shot piston 23 located in the cylinder portion 20 of the docking piston 12. The chamber of the cylinder portion 20 includes the top chamber 24 and the lower chamber 25.

Docking piston 12 is slidably mounted in cylinder 11 by bronze sleeve guide bearings 26, and 27. Guide bearing 27 is mounted within the inner wall of cylinder 11 by the bearing support 29. Item 30 is used to support seal 28.

Neck 19 of docking piston 12 extends upwardly through a bore 33 in the cylinder top closure 14. It is guided by the sleeve guide bearing 26 between neck 19 and bore 33. Piston rod 22 is guided by sleeve guide bearing 34 located between piston rod 22 and bore 21 of the neck 19. Neck 19 is attached to an adaptor 35 through a support base member 36 and shot stroke limiter 36A which supports the connector member or shot coupling 37 to which a shot rod or plunger 38 is connected. The adapter 35 supports an injection sleeve 39 by means of the rectangular bars or struts 40 and collar 41 which is keyed through the injection sleeve 39 by the key 42. The injection sleeve 39 includes a cavity 43 for receiving injectable metal which the tip 44 of the shot rod or plunger 38 is adapted to inject into the cavity of the die via passageway 46 leading to the cavity formed by the cavity parts 6*a* and 6*b* (see FIGS. 7–12).

It should be evident from the above description that when the docking piston 12 is forced upwardly by pressurized fluid, as will be described hereinafter, causing the injection sleeve to dock into the sleeve receptacle 45, the docking/shot assembly 10 is then in position for a shot of injectable material within the cavity 43 to be injected into the cavity of the die 5. When in such position, shot piston 23 is actuated by pressurized fluid, as will be described hereinafter, causing the head or tip 44 of rod or plunger 38 to inject the injectable material into cavity of die 5.

SUPPORT ASSEMBLY

Figure 4:
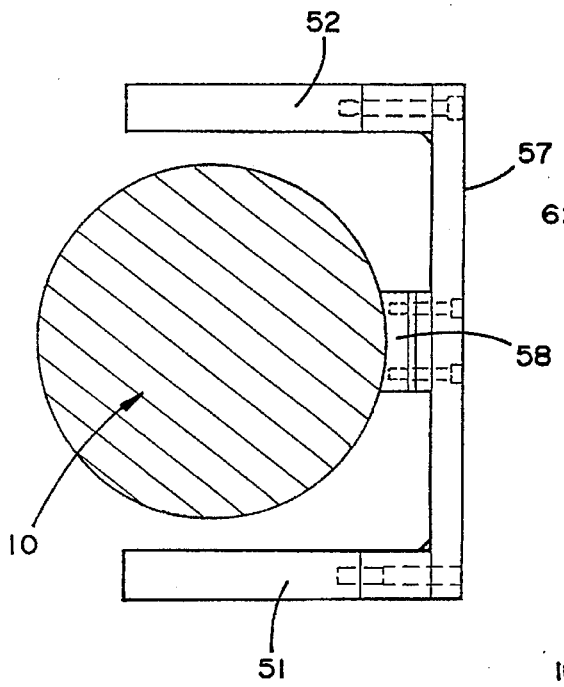
FIG. 4 is a cross-sectional view taken along the plane IV—IV of FIG. 3.

Support assembly 50 for the docking/shot assembly 10 includes spaced brackets 51 and 52 attached to a portion 2*a* of the front stationary platen 2. Portion 2*a* is of reduced width so as to extend between the beams 9*a* and 9*b*. Platen 2 has a cut-out 2*b* extending above the level of the tops of the beams 9*a* and 9*b* dividing the downwardly extending platen portion 2*a* into downwardly extending platen portions 2*c* and 2*d*. Bracket 51 has L-shaped surfaces 53 and 54. Surface 53 is attached to the rear face of the platen portion 2*c* by the bolts 53*a* and to the underside edge of platen portion 2*c* by the bolts 54*a*. Similarly, bracket 52 has L-shaped surfaces with a surface (not shown) attached to the rear face of platen portion 2*d* by the bolts and a surface attached to the underside of the edge of platen portion 2*d* by bolts. Both of the brackets 51 and 52 are curved at the lower end as illustrated by FIG. 1. At this lower end, the two brackets 51 and 52 are interconnected by the plate 57 on which is mounted the stop member 58 (FIG. 4). The docking/shot cylinder assembly 10 is pivotally mounted between the two brackets 51 and 52 by means of a collar 59 secured on the docking/shot assembly 10 and the trunnion 60 which can be of many different structures well known to those skilled in the art.

Figure 3:
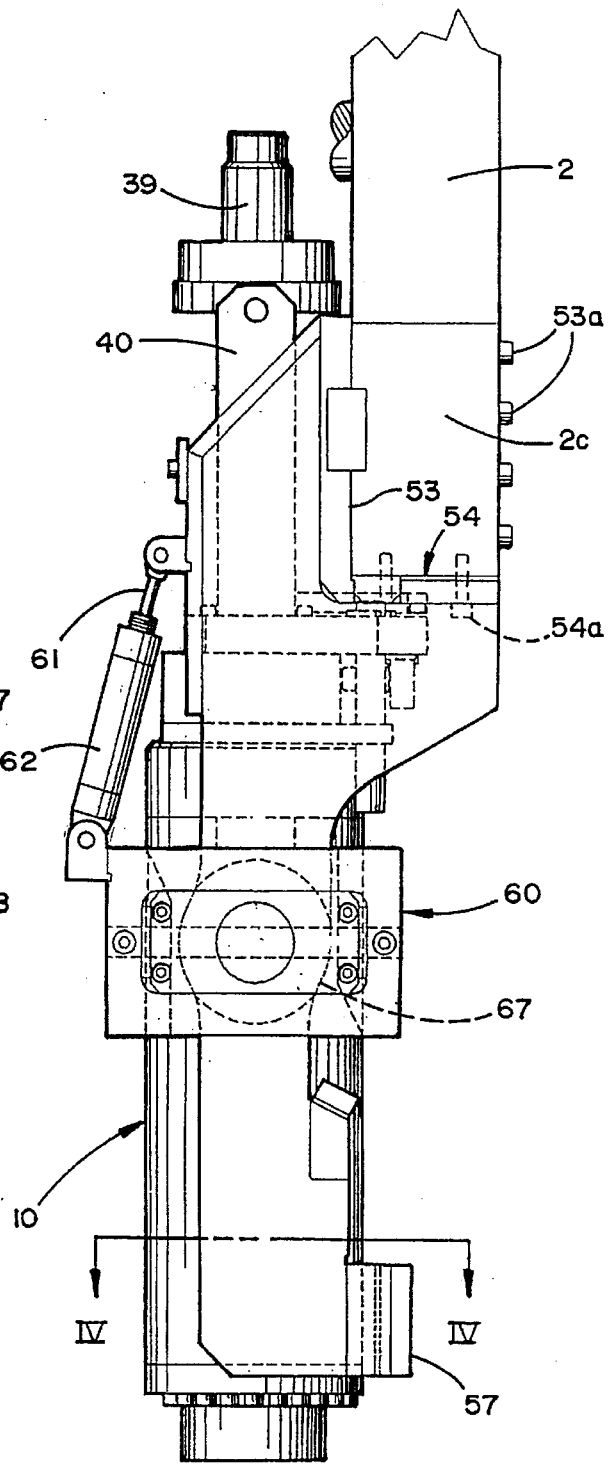
FIG. 3 is a side-elevational view of the support structure for the docking/shot assembly.
Figure 6:
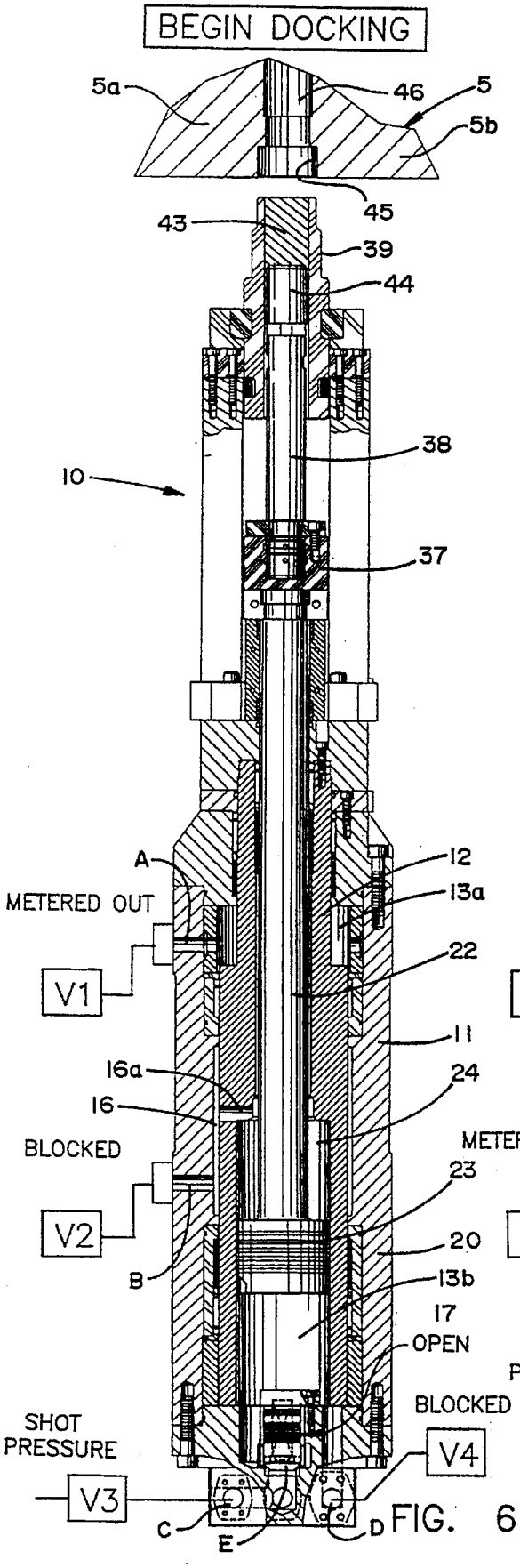
Figure 7:
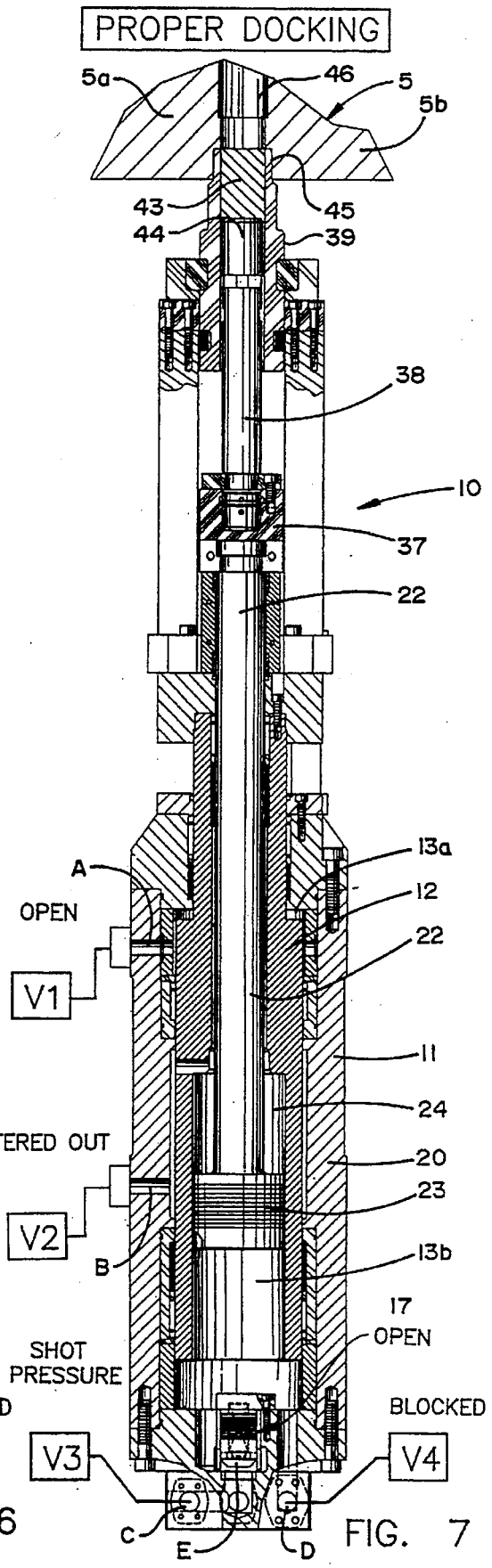

The two positions of the docking/shot assembly 10 are the tilted position of FIGS. 1 and 6 and the docking position of FIG. 3. Tilting is accomplished by providing hydraulic cylinders 61 (FIG. 1) for each of the brackets 51 and 52. Each of the hydraulic cylinders 61 have one end attached to its bracket and the piston rod of the cylinder attached to the pivotal mounting assembly 60 (FIGS. 1 and 3). As a result, the retraction of the piston rod 62 tilts the docking/shot assembly 10 to the position as shown in FIG. 1 while the extension of the piston rod 62 pivots the docking/shot assembly to the docking position of FIG. 3.

OPERATION

Having described all the various components of the present invention and the environment in which it is utilized, the operation of it should be evident especially when referring to FIGS. 5–12 which illustrate the various modes of operation.

FIG. 5 discloses the docking/shot assembly in the loaded and tilted position. In this position, both the docking piston 12 and shot piston 23 are retracted downwardly, this being accomplished by the proper operation of the valves V1, V2, V3, and V4. The valve V1 is subjected to pressurized fluid and controls the blocking of port or opening A and the introduction of pressurized fluid through or out of port or opening A. Valve V2 has the same control over the opening or port B while V3 has the same control over the port or opening C. Valve V4 controls the introduction of intensified pressurized fluid through the port or opening D. In the loaded and tilted position of FIG. 5 check valve 17 is closed by a spring action forcing the valve downwardly to close off the port or opening E. In the mode of FIG. 5, there is no flow of pressurized fluid in or out of cylinder 11. When the pistons 12 and 23 are down all fluid pressure is released from chambers 13*a* and 24. As will be noted in FIG. 6, the cavity 43 of the injection sleeve 39 is filled with the proper quantity of injectable liquid metal.

After loading the injectable metal in the injection sleeve, the fluid cylinder 61 is pressurized, causing piston rod 62 to be extended and the docking/shot assembly to be pivoted to the upright docking position of FIG. 3. In this position of FIG. 6, the central axis of the docking/shot assembly is located on the plane X ready to be docked. Next, valve V1 is actuated to permit fluid to be metered out of the port or opening A, valve V2 is still in the blocked position, and valve V3 is actuated to permit pressurized fluid to flow. through the port C which exerts an upward pressure on the check valve 17 overcoming the spring bias so as to open the port E and permit pressurized fluid to flow into the lower chamber 13*b*. Thus, pressure is exerted on shot piston 23 and docking piston 12 forcing the docking piston 12 upwardly into the docked position of FIG. 7. It is important to note that shot piston 23 and docking piston 12 move together by reason of the pressurized fluid within the chamber 24 of the docking piston since valve V2 blocks any flow of the pressurized fluid out of the opening B. It also should be noted that the metered position of valve V1 controls the speed of the docking position as it is forced to the docked position.

Figures 8, 9:
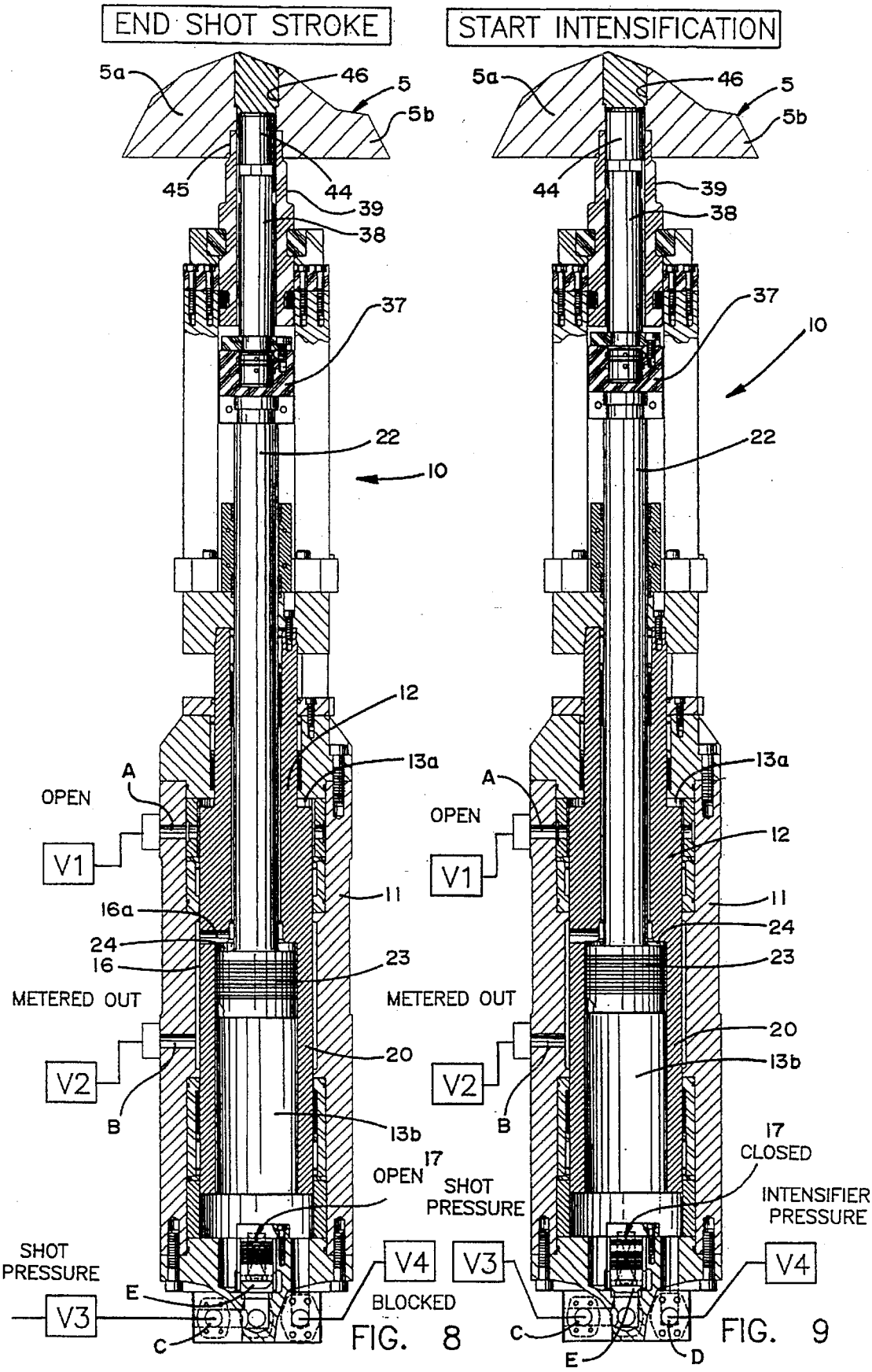

Having docked the injection sleeve 39 in the gate 45, the next step in the sequence of operations, as illustrated by FIG. 8, is the actuation of the shot piston 23. This is accomplished by conditioning valve V1 to open, conditioning valve V2 to a metered out position, and continuing the flow of pressurized fluid through ports or openings C and E. Shot piston 23 is then forced upwardly by reason of the pressurized fluid in the upper chamber 24 of the docking piston being flowed out through the opening or port 16*a*, recess 16, and out of port or opening B. During this operation, the docking piston continues to hold the injection sleeve in the gate 45 while the injectable metal in cavity 43 is forced by plunger tip 44 through the passageway 46 and into the cavity 6 of the die 5.

The next step in the sequence is illustrated by FIG. 9 wherein intensified pressurized fluid is introduced through the port or opening D by means of conditioning valve V4. At the same time, valves V1, V2, and V3 remain in the same condition as in FIG. 8. However, check valve 17 shuttles and is closed due to the pressure differential on its top and bottom surfaces. The intensified pressure on shot piston 23 causes it to be forced upwardly a slight distance as illustrated by a comparison of the chambers 13*a* in FIGS. 8 and 9. This additional movement assures that all of the injectable metal is injected into cavity 6 formed by cavity portions 6*a* and 6*b* to completely fill cavity 6.

Figure 10:
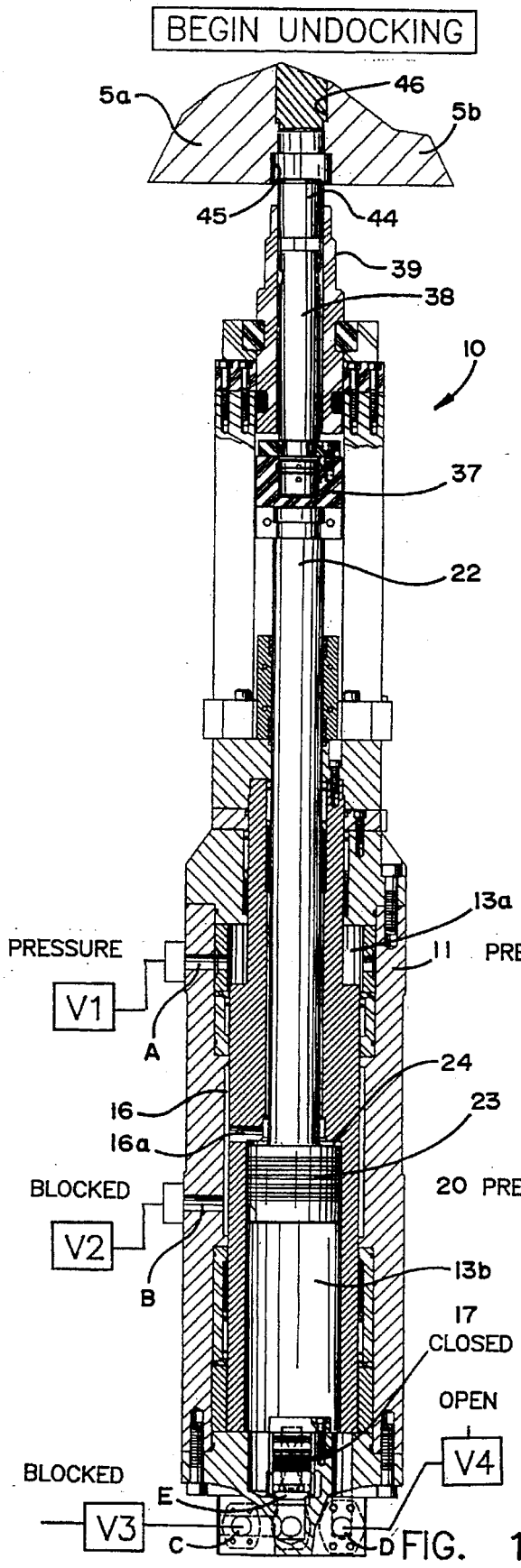
Figure 11:
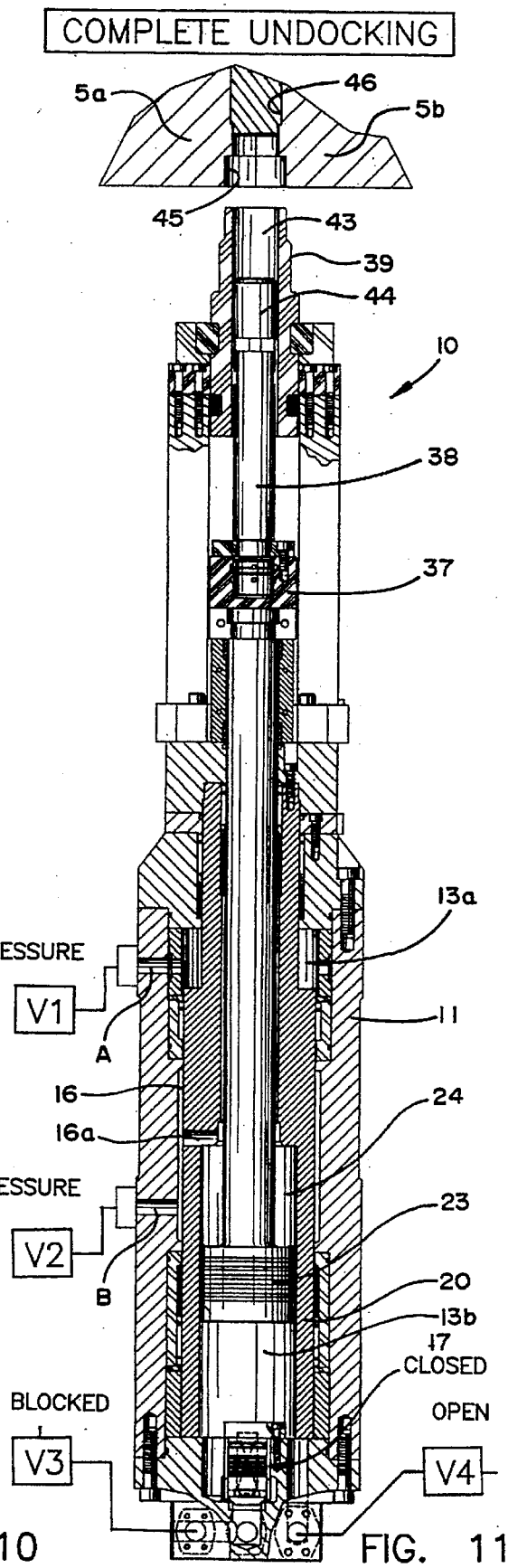

FIG. 10 illustrates the next step in the sequence which is to begin undocking of the injection sleeve 39. This is accomplished by conditioning valve V1 to permit pressurized fluid to flow through the port or opening A into the upper chamber 13*a* of the docking cylinder 11. At the same time, valve V2 is conditioned to block any exit of fluid from the opening or port B. The pressurized fluid in upper chamber 13*a* forces the docking piston downwardly to the position as disclosed in FIG. 10 while valve V3 is blocked and valve V4 is open to permit the flow of fluid in the lower chamber 13*b* to flow out of the opening or port D.

When the docking piston reaches the lowermost position, as disclosed in FIG. 10, valve V2 is conditioned to cause pressurized fluid to flow through the opening or port B into the recess 16 and through the opening 16*a* to the upper chamber 24 of the docking piston. At the same time, valve V1 is still admitting pressurized fluid into the upper chamber 13*a* of the outer docking cylinder 11 and valve V4 is open to permit flow of fluid out of the opening D while the port C is closed by valve V3. This mode in the operation is disclosed in FIG. 11.

Figure 12:
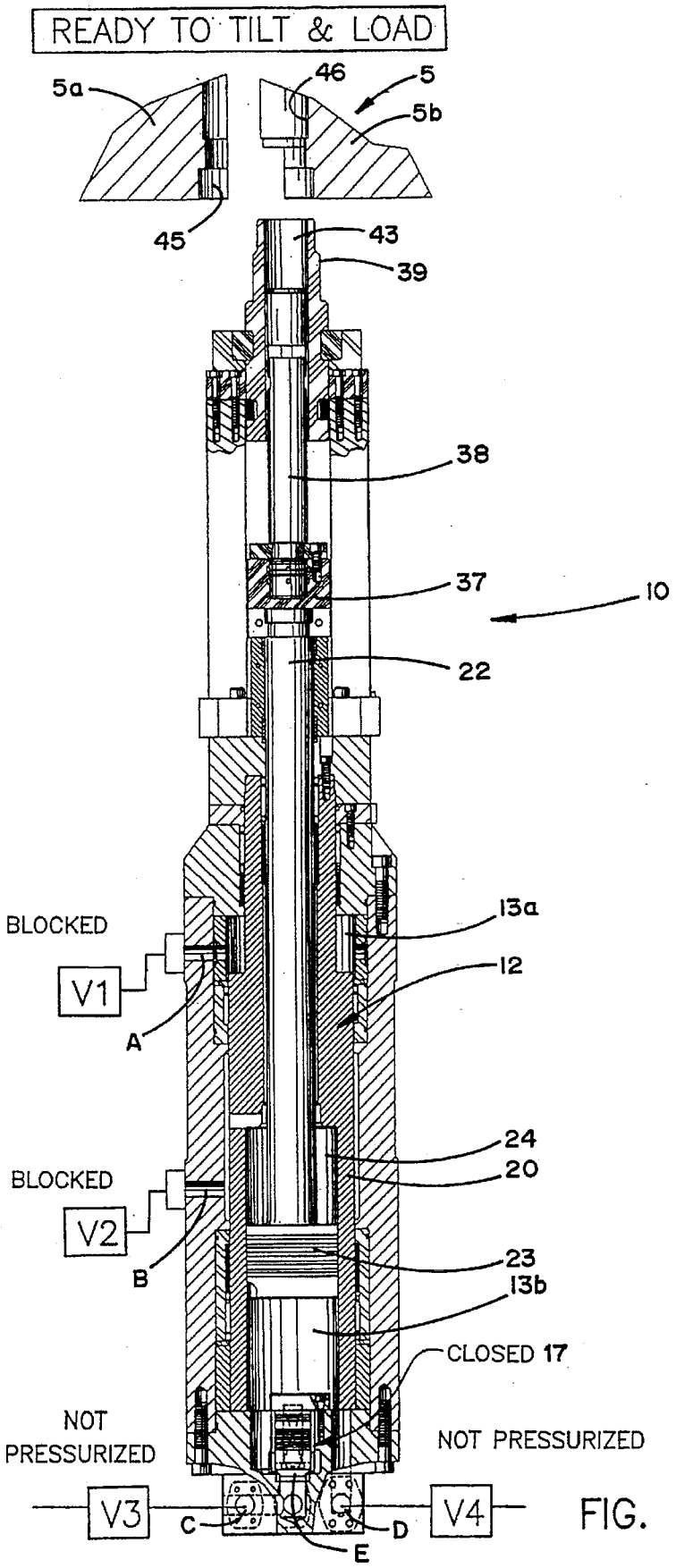

When the shot piston 23 reaches its lowermost position, the condition of the valves V1, V2, V3, and V4 are returned to the original conditions of FIG. 5 which puts the docking/shot assembly in a mode ready to be tilted and loaded after it is tilted to the positions of FIGS. 1 and 5. This is shown in FIG. 12.

It is evident from the above description in conjunction with the drawings that we have provided a unique and novel die casting apparatus. Included in this apparatus is a unique and novel docking/shot assembly that is relatively compact as compared to other previous docking and shot assemblies. Thus, it occupies substantially less space under the bottom of the die or mold which, in many instances, requires a needed space for mounting apparatus such as actuating assemblies for movable core elements. In addition, our docking/shot assembly utilizes the same hydraulic fluid to dock the injection sleeve and produce the shot of injectable metal into the cavity of the die. Therefore, the apparatus is more simplified than prior art horizontal/vertical die casting machines.

Further, we have provided a unique and novel structure for supporting the docking/shot assembly of the present invention. Such structure with some modifications can also be utilized for mounting and tilting other docking/shot assemblies.

Although we have described the preferred embodiment of the present invention, it should be understood that the docking/shot assembly as above described can be utilized in a vertical/vertical die casting machine wherein both the clamping mechanism and the docking/shot assembly are both vertically oriented, and in fact, the docking shot assembly can possibly be used in other die casting apparatus. In addition, although the invention has been described in terms of a specific preferred embodiment, it should be understood that various modifications may be made within the scope and spirit of the invention.

The embodiments of the invention in which an exclusive property or privilege is claimed are defined as follows:

1. In a die casting apparatus including a die body having a cavity and a sleeve receptacle communicating with said cavity, a shot cylinder assembly having an injection sleeve with a docking/shot assembly for docking said sleeve into communication with said sleeve receptacle for injecting a shot of injectable metal into said cavity, the improvement comprising:

said docking/shot assembly comprising a compound cylinder including a first cylinder having a first chamber;

a docking piston located in said first chamber and having a second cylinder with a second chamber;

a shot piston located in said second chamber;

a source of pressurized fluid; and valve means for causing said pressurized fluid to first actuate said docking piston in said first chamber to dock said sleeve in said sleeve receptacle and then actuate said shot piston in said second chamber to produce injection of said metal into said cavity.

2. The die casting apparatus of claim 1 in which said compound cylinder includes said first chamber having an upper chamber portion and a lower camber portion, said docking piston slidably mounted in said first chamber and having said second chamber located and open at its lower end, said shot piston slidably mounted in said second chamber, said shot piston providing a surface accessible to pressure in said lower chamber portion for assisting in the actuation of said docking position.

3. The die casting apparatus of claim 2 in which said first cylinder includes a first inlet communicating with said lower chamber portion for passing pressurized fluid into said lower chamber portion to actuate said docking piston; said first cylinder having a first opening at its upper end communicating with said upper chamber portion; said first cylinder having a second opening; said docking piston having a third opening communicating with said second chamber and with said second opening in all positions of said docking piston; and said valve means including means for simultaneously causing pressurization of said lower chamber portion through said inlet opening of said first chamber while closing the second opening to prohibit flow of fluid out of said second chamber and opening the first opening to permit flow of fluid out of said first opening whereby the pressurization of said lower end of said first chamber applies pressure to said shot piston and said docking piston to actuate said docking piston.

4. The die casting apparatus of claim 1 in which the first cylinder has a first inlet communicating with the lower end of said first chamber, a first opening, and a second opening; said first opening communicating with said first chamber above said docking piston when in a lower retracted position; said docking piston having a third opening communicating with said second chamber and said second opening; said valve means being adapted to simultaneously (a) cause said pressurized fluid to pass through said first inlet into the lower end of said first chamber to apply fluid pressure to said shot and docking pistons, (b) to cause fluid above said docking piston to flow out of the upper end of said first chamber above said docking piston, and (c) to prohibit flow of fluid through said second opening and out of said second chamber above said shot piston whereby the shot piston and docking piston are simultaneously moved together to dock said sleeve into said sleeve receptacle.

5. The die casting apparatus of claim 2 in which the first cylinder has a first inlet communicating with the lower end of said first chamber, a first opening, and a second opening; said first opening communicating with said first chamber above said docking piston when in a lower retracted position; said docking piston having a third opening communicating with said second chamber and said second opening; said valve means being adapted to simultaneously (a) cause pressurized fluid to pass through said first inlet into the lower end of said first chamber to apply fluid pressure to said shot and docking pistons, (b) to cause fluid above said docking piston to flow out of the upper end of said first chamber above said docking piston and (c) to prohibit flow of fluid through said second opening and out of said second chamber above said shot piston whereby the shot piston and docking piston are simultaneously moved together to dock said sleeve into said sleeve receptacle.

6. The die casting apparatus of claim 3 in which after said sleeve is docked into said sleeve receptacle, said valve means is adapted to permit fluid within said second chamber to flow out of said second opening whereby pressurized fluid in the lower end of the first chamber will cause said shot piston to move in said second chamber relative to said docking piston whereby injectable metal in said injection sleeve is injected into said cavity of said die body.

7. The die casting apparatus of claim 4 in which after said sleeve is docked into said sleeve receptacle, said valve means is adapted to permit fluid within said second chamber to flow out of said second opening whereby pressurized fluid in the lower end of the first chamber will cause said shot piston to move in said second chamber relative to said docking piston whereby injectable metal in said injection sleeve is injected into said cavity of said die body.

8. The die casting apparatus of claim 5 in which after said sleeve is docked into said sleeve receptacle, said valve means is adapted to permit fluid within said second chamber to flow out of said second opening whereby pressurized fluid in the lower end of the first chamber will cause said shot piston to move in said second chamber relative to said docking piston whereby injectable metal in said injection sleeve is injected into said cavity of said die body.

9. The die casting apparatus of claim 6 in which is provided a second inlet communicating with said lower end of said first chamber; said valve means being adapted to cause fluid under intensified pressure to flow through said second inlet after said sleeve is docked in said sleeve receptacle and said metal is injected into said cavity; and a check valve located between said first inlet and lower end of said first chamber, said check valve being actuated by the differential fluid pressure exerted by said fluid under intensified pressure to close said first inlet.

10. The die casting apparatus of claim 7 in which is provided a second inlet communicating with said lower end of said first chamber; said valve means being adapted to cause fluid under intensified pressure to flow through said second inlet after said sleeve is docked in said sleeve receptacle and said metal is injected into said cavity; and a check valve located between said first inlet and lower end of said first chamber, said check valve being actuated by the differential fluid pressure exerted by said fluid under intensified pressure to close said first inlet.

11. The die casting apparatus of claim 8 in which is provided a second inlet communicating with said lower end of said first chamber; said valve means being adapted to cause fluid under intensified pressure to flow through said second inlet after said sleeve is docked in said sleeve receptacle and said metal is injected into said cavity; and a check valve located between said first inlet and lower end of said first chamber, said check valve being actuated by the differential fluid pressure exerted by said fluid under intensified pressure to close said first inlet.

12. The die casting apparatus of claim 10 in which an actuator is connected between said bracket and cylinder assembly for tilting said cylinder assembly.

13. In a die casting apparatus including a stationary front platen, a movable platen, and a die body located between said stationary and front platens, said die body having a cavity and a sleeve receptacle communicating with said cavity; a vertical shot cylinder assembly having an injection sleeve with a docking/shot cylinder assembly for docking said sleeve into said sleeve for injecting a shot of injectable metal into said cavity; a pair of spaced elongated support members for supporting said platens; a support subassembly for supporting said docking/shot cylinder assembly; said subassembly support comprising a tilting mechanism for tilting said cylinder assembly from an upright position aligned for docking to a tilt position for said injection sleeve to receive injectable metal, the improvement comprising:

said front platen including a downwardly extending portion located between said elongated support members and having a cut-out extending upwardly from the lower edge of said downwardly extending portion through a space between said elongated support members;

a support bracket assembly attached to said downwardly extending portion on each side of said space and supporting said docking/shot assembly, said support bracket depending from said downwardly extending portion and having a pivotal mounted support assembly for pivotally mounting said docking/shot assembly whereby said docking/shot assembly is pivotally mounted on said support bracket assembly so as to be pivoted from a tilted position through said space to a ready docking position;

said docking/shot assembly comprising a compound cylinder including a first cylinder having a first chamber;

a docking piston located in said first chamber and having a second cylinder with a second chamber;

a shot piston located in said second chamber;

a source of pressurized fluid; and valve means for causing said pressurized fluid to first actuate said docking piston in said first chamber to dock said sleeve in said sleeve receptacle and then actuate said shot piston in said second chamber to produce a shot of said metal into said cavity.

14. The die casting apparatus of claim 13 in which said compound cylinder includes said first chamber having an upper chamber portion and a lower chamber portion, said docking piston slidably mounted in said first chamber and having said second chamber located and open at its lower end; said shot piston slidably mounted in said second chamber, said shot piston providing a surface accessible to pressure in said lower chamber portion for assisting in the actuation of said docking position.

15. The die casting apparatus of claim 14 in which said first cylinder includes a first inlet communicating with said lower chamber portion for passing pressurized fluid into said lower chamber portion to actuate said docking piston; said first cylinder having a first opening at its upper end communicating with said upper chamber portion; said first cylinder having a second opening; said docking piston having a third opening communicating with said second chamber and with said second opening in all positions of said docking piston; and said valve means including means for simultaneously causing pressurization of said lower chamber portion through said inlet opening of said first chamber while closing the second opening to prohibit flow of fluid out of said second chamber and opening the first opening to permit flow of fluid out of said first opening whereby the pressurization of said lower end of said first chamber applies pressure to said shot piston and said docking piston to actuate said docking piston.

16. The die casting apparatus of claim 13 in which the first cylinder has a first inlet communicating with the lower end of said first chamber, a first opening, and a second opening; said first opening communicating with said first chamber above said docking piston when in a lower retracted position; said docking piston having a third opening communicating with said second chamber and said second opening; said valve means being adapted to simultaneously (a) cause said pressurized fluid to pass through said first inlet into the lower end of said first chamber to apply fluid pressure to said shot and docking pistons, (b) to cause fluid above said docking piston to flow out of the upper end of said first chamber above said docking piston, and (c) to prohibit flow of fluid through said second opening and out of said second chamber above said shot piston whereby the shot piston and docking piston are simultaneously moved together to dock said sleeve into said sleeve receptacle.

17. The die casting apparatus of claim 14 in which the first cylinder has a first inlet communicating with the lower end of said first chamber, a first opening, and a second opening; said first opening communicating with said first chamber above said docking piston when in a lower retracted position; said docking piston having a third opening communicating with said second chamber and said second opening; said valve means being adapted to simultaneously (a) cause pressurized fluid to pass through said first inlet into the lower end of said first chamber to apply fluid pressure to said shot and docking pistons, (b) to cause fluid above said docking piston to flow out of the upper end of said first chamber above said docking piston and (c) to prohibit flow of fluid through said second opening and out of said second chamber above said shot piston whereby the shot piston and docking piston are simultaneously moved together to dock said sleeve into said sleeve receptacle.

18. The die casting apparatus of claim 14 in which after said sleeve is docked into said sleeve receptacle, said valve means is adapted to permit fluid within said second chamber to flow out of said second opening whereby pressurized fluid in the lower end of the first chamber will cause said shot piston to move in said second chamber relative to said docking piston whereby injectable metal in said injection sleeve is injected into said cavity of said die body.

19. The die casting apparatus of claim 13 in which after said sleeve is docked into said sleeve receptacle, said valve means is adapted to permit fluid within said second chamber to flow out of said second opening whereby pressurized fluid in the lower end of the first chamber will cause said shot piston to move in said second chamber relative to said docking piston whereby injectable metal in said injection sleeve is injected into said cavity of said die body.

20. The die casting apparatus of claim 17 in which after said sleeve is docked into said sleeve receptacle, said valve means is adapted to permit fluid within said second chamber to flow out of said second opening whereby pressurized fluid in the lower end of the first chamber will cause said shot piston to move in said second chamber relative to said docking piston whereby injectable metal in said injection sleeve is injected into said cavity of said die body.

21. The die casting apparatus of claim 18 in which is provided a second inlet communicating with said lower end of said first chamber; said valve means being adapted to cause fluid under intensified pressure to flow through said second inlet after said sleeve is docked in said sleeve receptacle and said metal is injected into said cavity; and a check valve located between said first inlet and lower end of said first chamber, said check valve being actuated by the differential fluid pressure exerted by said fluid under intensified pressure to close said first inlet.

22. The die casting apparatus of claim 19 in which is provided a second inlet communicating with said lower end of said first chamber; said valve means being adapted to cause fluid under intensified pressure to flow through said second inlet after said sleeve is docked in said sleeve receptacle and said metal is injected into said cavity; and a check valve located between said first inlet and lower end of said first chamber, said check valve being actuated by the differential fluid pressure exerted by said fluid under intensified pressure to close said first inlet.

23. The die casting apparatus of claim 20 in which is provided a second inlet communicating with said lower end of said first chamber; said valve means being adapted to cause fluid under intensified pressure to flow through said second inlet after said sleeve is docked in said sleeve receptacle and said metal is injected into said cavity; and a check valve located between said first inlet and lower end of said first chamber, said check valve being actuated by the differential fluid pressure exerted by said fluid under intensified pressure to close said first inlet.

* * * * *